US007318308B2

(12) United States Patent
Schmetzer

(10) Patent No.: US 7,318,308 B2
(45) Date of Patent: Jan. 15, 2008

(54) METHOD FOR STRAPPING AND ESPECIALLY LONGITUDINALLY STRAPPING PACKAGED MATERIAL WITH A STRAP

(76) Inventor: Helmut Schmetzer, Almstr. 5, D-95448 Bayreuth (DE)

( * ) Notice: Subject to any disclaimer, the term of this patent is extended or adjusted under 35 U.S.C. 154(b) by 702 days.

(21) Appl. No.: 10/616,651

(22) Filed: Jul. 9, 2003

(65) Prior Publication Data

US 2006/0242926 A1 Nov. 2, 2006

(30) Foreign Application Priority Data

Jul. 18, 2002 (DE) ..... 102 32 580

(51) Int. Cl.
*B65B 13/06* (2006.01)
*B65B 41/16* (2006.01)

(52) U.S. Cl. ..... 53/589; 53/389.4

(58) Field of Classification Search ..... 53/589, 53/389.4

See application file for complete search history.

(56) References Cited

U.S. PATENT DOCUMENTS

| | | | | | |
|---|---|---|---|---|---|
| 2,905,406 | A | | 9/1959 | Falck-Pdersen | |
| 3,045,403 | A | * | 7/1962 | Mitchell | 53/74 |
| 3,331,312 | A | * | 7/1967 | Leslie et al. | 100/28 |
| 3,351,302 | A | * | 11/1967 | Lang | 242/156.2 |
| 3,391,520 | A | * | 7/1968 | Albrecht | 53/202 |
| 3,602,452 | A | | 8/1971 | Sauer | |
| 3,665,845 | A | * | 5/1972 | Lyon | 100/27 |
| 3,952,961 | A | | 4/1976 | Antepenko | |
| 3,963,191 | A | | 6/1976 | Goodley | |
| 3,995,791 | A | * | 12/1976 | Schoppee | 242/421.7 |
| 4,185,442 | A | * | 1/1980 | Johnson et al. | 53/168 |
| 4,554,779 | A | * | 11/1985 | Fischer | 53/589 |
| 4,559,767 | A | * | 12/1985 | Takami | 53/589 |
| 4,559,977 | A | | 12/1985 | Dilley | |
| 4,782,648 | A | * | 11/1988 | Van Ottele | 53/553 |
| 5,236,329 | A | * | 8/1993 | Sylvester | 53/399 |
| 5,615,538 | A | * | 4/1997 | Miyashita et al. | 53/589 |
| 5,916,108 | A | * | 6/1999 | Drietz et al. | 53/370 |
| 6,457,667 | B1 | * | 10/2002 | Golightly et al. | 242/421.5 |
| 2003/0200731 | A1 | * | 10/2003 | Maki-Rahkola et al. | 53/589 |

FOREIGN PATENT DOCUMENTS

| | | |
|---|---|---|
| CH | 652 086 | 10/1985 |
| DE | 22 47 594 | 4/1973 |
| DE | 200 07 232 | 7/2000 |
| EP | 0 303 129 | 2/1989 |

* cited by examiner

*Primary Examiner*—John Sipos
(74) *Attorney, Agent, or Firm*—Jordan and Hamburg LLP

(57) ABSTRACT

Device for strapping, especially for longitudinally strapping packaged material with strapping, comprising a strap roll, from which the strapping, which is to be processed, is pulled with formation of a strap storage system for a subsequent strapping process. A movable strap carrier is provided for pulling off the strapping and can be moved from a first position into a second position, taking along the strapping, while the strapping is arrested at a place, downstream from the strap carrier with the aid of holding means.

14 Claims, 2 Drawing Sheets

METHOD FOR STRAPPING AND ESPECIALLY LONGITUDINALLY STRAPPING PACKAGED MATERIAL WITH A STRAP

BACKGROUND OF THE INVENTION

The invention relates to a device for strapping, especially for longitudinally strapping packaged material with a strap, comprising a strap roll, from which strapping, which is to be processed, is pulled with formation of a strap storage system for a subsequent strapping process.

Such a device is known, for example, from DE 200 07 232 U1. For this device, the packaged material, which is to be strapped, such as a stack of catalogs or newspapers, is placed by a preparing facility, the details of which are not described, on the device table. In or at the preparing table, a strapping roll is provided, from which the strapping is pulled off into a strap storage system, in which it is guided in a meandering fashion and runs into an injection device, by means of which it is injected into a channel-like strap-guiding frame embracing the packaged material. The free front end of the strap is captured once again and passed into a welding device where, after being stretched around the packaged material, for which purpose the strap is taken from the strap-guiding frame, it is welded, after which it is cut off. The strap is pulled by the injection process from the strap roll and the strap storage system is filled continuously, so that sufficient unrolled strapping for an injection process is always available in the strap storage system.

Known strapping devices have an automatic strap infeed. This means that the strapping is pulled automatically from the strap roll and conveyed to the storage system, where it is deposited in meandering fashion. For this purpose, a devise for determining the weight of the strap in the storage system is usually provided and frequently constructed as a rocker and controlled over the strap infeed. If the supply of strap is inadequate, the rocker, over suitable switching means, switches on the strap infeed and strap is passed automatically from the strop roll to the storage system. When a specified degree of filling and, with that, a corresponding weight of strap are attained, the rocker tilts and the switching means switch off the strap infeed. The strap infeed thus is controlled by the position of the rocker. As a rule, the storage system contains three to four times the length of strap for a strapping process. The equipment costs for this known strap infeed are appreciably high. Malfunctioning of the rocker is possible so that, at times, the whole of the infeed operation does not function properly.

SUMMARY OF THE INVENTION

It is an object of the invention to indicate a device, which has a simply constructed strap infeed mechanism.

For a device of the type named above, this objective is accomplished pursuant to the invention by a movable strap carrier, which is provided for pulling off the strapping and can be moved from a first to a second position, taking along the strapping, and by providing holding means at a place downstream from the strap carrier for arresting the strapping.

The inventive strapping device provides a strap carrier, which can be moved only between two positions. During a movement from the first into second position, the carrier carries along the strap, which is held by suitable holding means in the region between point of action of the strap carrier and the injection device at least over a portion of the lengths between the first and the second position, so that the strapping necessarily is unwound from the roll because of the catch at the other end. The strap is passed into the strap storage system during this movement by the strap carrier. In comparison to previously known automatic infeeds, the design of the pull-off mechanism, proposed pursuant to the invention and using only a movable strap carrier, is appreciable simpler.

In a further development of the inventive concept, provisions can be made so that the strap carrier functions as a re-tensioning device for strapping passed around the packaged material, the re-tensioned strap length being conveyed into the strap storage system before the strap is pulled from the roll of strap. For this purpose, second holding means, which are upstream from the strap carrier and preferably close to the roll, are provided for arresting the strapping. In accordance with this development of the invention, this strap carrier has not only a strap infeed function, but also, at the same time, a tensioning function. In other words, it has a double function and replaces the otherwise customary re-tensioning device. After is has been injected into a strap-guiding frame surrounding the packaged material, the strapping is fixed close to the roll by the second holding means, which have been provided pursuant to the invention. After it has been captured in the welding device and arrested there, the strapping is taken from the strap-guiding frame, so that it can be stretched around the packaged material. This is accomplished by means of the strap carrier, which is moved, for this purpose, from the first position and, placed around the packaged material, is stretched. The holding means, downstream from the strap carrier, are opened at this time, so that the strap can be fetched back, while the holding means, near the roll and upstream in the strap carrier, arrests the strap. Only when a specified tension has been reached, do the downstream holding means close and the upstream holding means near the roll open, so that the strapping, on the further path of movement to the second position, can be pulled off from the strap roll. This inventive development thus makes it possible to do without the complex construction of the strap infeed control as well as without a separate re-tensioning device, since both functions are carried out by the strap carrier, which has been provided pursuant to the invention. Moreover, the strapping can be tensioned at any tension around the packaged material with the inventive strap carrier, since the latter stretches the strap by a longitudinal movement and, in the final analysis, the stretching force depends only on how far the strap carrier is moved along its path. This is also an appreciable advantage over previously used re-tensioning devices, which use either re-tensioning rolls or re-tensioning clamps. These frequently do not permit a higher strap tension to be produced, since they slip off from the strap and the like.

Moreover, pursuant to the invention, the length of the movement of the strap carrier between the first and second positions can be such that as much strap is passed into the strap storage system, as is required for the subsequent strapping process, so that it is ensured that the strap storage system is always filled with the lengths of strap actually required and that the amount of strap, passed into the storage system, is neither too much nor too little. This is a further appreciable advantage over the state of the art where, as a rule, three to four lengths of strap, required for a strapping process, are present in the storage system, where it frequently happens that the strap twists, which is disadvantageous for the subsequent injection process. If, for example, the strapping device is stopped overnight, the strap, deposited in meandering fashion, frequently assumes this meandering shape, which means that it has molded curves or bends, which prevent injection. Owing to the fact that one strap length at most is in the storage system, these disadvantages are also largely to be avoided. An advantageous further development of this inventive concept provides that the lengths, by which the strap carrier moves between the first and the second positions, can be adjusted. By these means, the strap length in the storage system can necessarily be shortened or lengthened. By these means, the device can readily the adapted to the geometry of new packaged material, which is to be taken hold off. Nevertheless, it can be ensured that only the length of strap, actually required, is passed into the storage system.

Pursuant to the invention, the strap carrier can be constructed as a pivoted lever, which advisably can be swiveled about the axis of rotation of the roll of strapping. For this purpose, suitable driving means, for example, in the form of an electric motor or the like, are provided in order to move the lever between the two positions. Alternatively to the pivoted lever, which carries out a circular motion, it is also conceivable to provide a carrier, which can be moved along a straight line, such as a rail-guided carrier element or the like. Such a rail-guided carrier element can, however, also, of course, be guided along a curved path of motion, so that a curved path of motion between the two positions, such as exists in the case of a pivoted lever, can also be realized by such a construction of a carrier.

Advisably, the first and optionally also the second holding means are constructed as clamping means, for example, as mutually opposite clamping jaws, between which the strapping is passed. These clamping means can be operated electrically, pneumatically and hydraulically.

The pivoted lever may be constructed as a single arm pivoted lever, which is moved laterally next to the strapping and, over a suitable carrier element, which protrudes from the pivoted lever, carries the strap along. It is, however, advisable, especially for stability reasons, that the strap carrier, constructed as a pivoted lever, has two pivoting arms, which can be moved at the side of the roll of strap and are connected over a connecting section engaging the strapping.

Clock cycles of different lengths can be employed depending on the configuration of the device. This means that the strapping processes can take place very rapidly one after the other or with longer time intervals between such processes. If the device is one, which operates slowly, then it is readily possible to move the strap carrier without modification from the second position back into the first, before the strap is pulled out of the strap storage position. If the device operates more rapidly, the problem may arise that the strap carrier cannot be moved back into the first position, before the strapping is pulled out again from the strap storage system because of an injection process. In such a case, the strapping, pulled out of the storage system, would bump against the strap carrier, which is still in the pulling-out path, resulting in interference with the injection process, since the strapping cannot be pulled completely out of the storage system. In order to solve this problem, especially in the case of rapidly cycling devices, provisions are made in a further development of the inventive concept that the strap carrier can be shifted along or parallel to the axis of rotation of the roll of strap at least for carrying out the return movement into the first position. This inventive configuration thus sees to it that the strap carrier or the carrier element, which actually engages the strap during the movement, is moved out of the pulling-out path of the strapping, when it is pulled out of the storage system, in that strap carrier is pushed somewhat to the side so that, de facto, the carrier section engaging the strapping, is positioned in each case laterally next to the strap and guided back in this position. A strap, now pulled out of the storage system, is pulled passed the strap carrier or its carrier section, so that the latter does not interfere with the withdrawal of the strap. If the strap carrier is a pivoted lever having two pivoted arms, it is appropriate if the section connecting the two pivoted arms is in two parts and at least one of the pivoted arms can be swiveled or shifted along the swiveling axis or parallel to the latter (if this pivoted level cannot be swiveled or shifted about the axis of rotation of the roll). This means that only one pivoted lever, together with the connecting section engaging the strap, is moved to the side. However, since the strap pulled off from the roll usually migrates from left to right on the roll body as it is being unwound, and therefore guided to different positions at the connecting section, it is appropriate if the two pivoted arms can be shifted laterally, since the strap is passed to one or the other part of the connecting sections, depending on the position of the roll.

A roll or roller, which optionally forms the connecting section or generally the carrying element and on which the strap, which is to be pulled off, runs, is provided at the strap carrier. Of course, if the connecting section is divided into two, two such rolls or rollers are provided.

Advisably, holding elements for holding the strapping, introduced by the movement of the strap carrier, are provided in the strap storage system itself. This holding elements may be constructed, for example, as brushes.

Further advantages, distinguishing features and details of the invention arise out of the example, which is described in the following, as well as in the accompanying drawings.

DESCRIPTION OF THE PREFERRED EMBODIMENTS

FIGS. 1, 3, 5 and 7 show the inventive device as a diagrammatic representation in a sectional view and FIGS. 2, 4, 6 and 8 show the relevant, uncut, components of the device in a view rotated by 90°.

Figure 1:
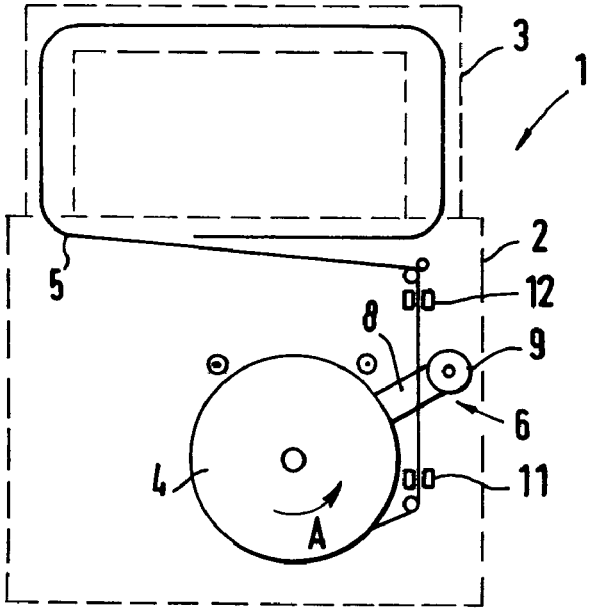
FIG. 1 shows a diagrammatic representation of the inventive device after the injection of a strap in a side view.
Figure 2:
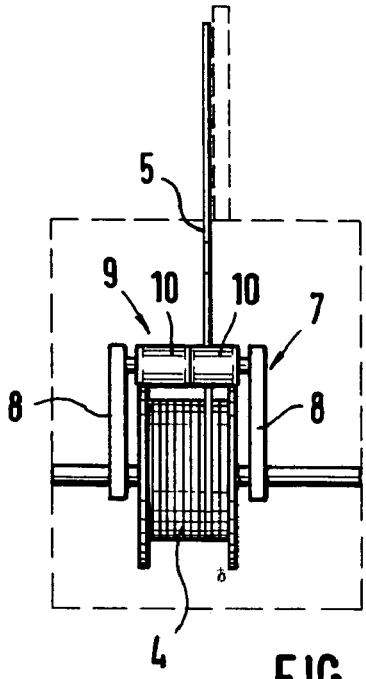
FIG. 2 shows a device of FIG. 1, in a view rotated by 90°.

FIG. 1 shows an inventive device 1, comprising a device table 2, at which the strap-guiding frame 3 is disposed. In or at the device table 2, a roll 4 for the strapping is provided and can be rotated about the axis A. Strapping 5 is unwound from this roll 4. As shown in FIG. 1, this strapping 5 is injected into the strap-guiding frame 3 by means an injecting device, the details of which are not shown. The free end is captured and passed into a welding device, the details of which are also not shown. The injected strapping is then stretched around the packaged material, such as a stack of catalogues or newspapers, after which it is welded and cut off. These fundamental processes are adequately known in the art and it is not necessary to deal with them in greater detail, since they are not part of the invention.

As shown in FIG. 1, a strap carrier 6 in the form of a pivoted lever 7 with two pivoted arms 8, which are connected to one another by a two-part connecting section part 9, consisting of two rolls 10, is provided in the region of the strap roll. The pivoted lever 7 or its two pivoted arms 8 can be rotated about the same axis of rotation as the strap roll 4. This will still be dealt with in the following. The pivoted lever can be moved between a first position, shown in FIG. 1 and a second position, shown in FIG. 5, by an electric motor. A pneumatically or hydraulically controlled lever movement is also conceivable.

Clamping means 11, such as two clamping jaws, between which the strapping 5 is passed, are upstream from the strap carrier 6. Furthermore, additional clamping means 12, also consisting, for examples, of two clamping jaws, are downstream from the strap carrier 6. The two clamping means 11, 12 can be actuated separately by electrical, pneumatic or hydraulic means. They serve to clamp the strapping, which is passed between them, depending on the cycle, in which the device is.

FIG. 1 shows, as described, the situation after the injection of the strapping 5 into the strap-guiding frame. The strap carrier 6 is in its first position, in which it does not engage the strapping 5.

Figure 3:
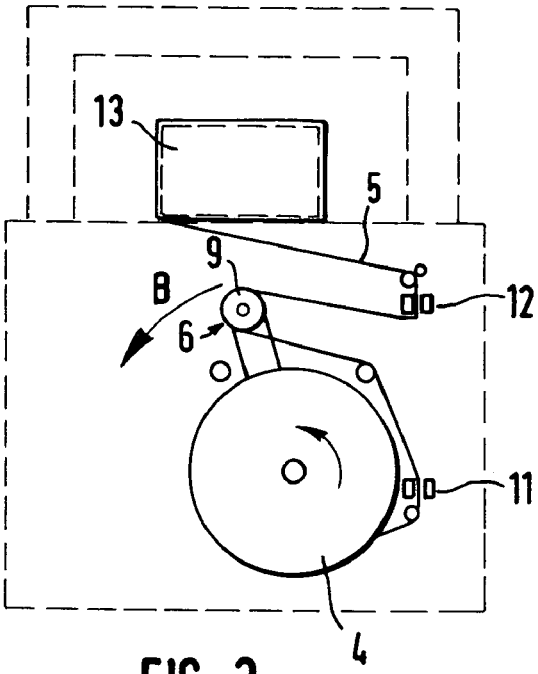
FIG. 3 shows a device of FIG. 1, after the injected strapping has been stretched around the packaged material and welded.
Figure 4:
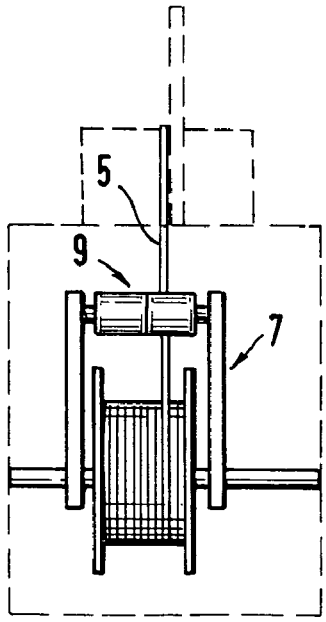
FIG. 4 shows a device of FIG. 3, in a view rotated by 90°.
Figure 5:
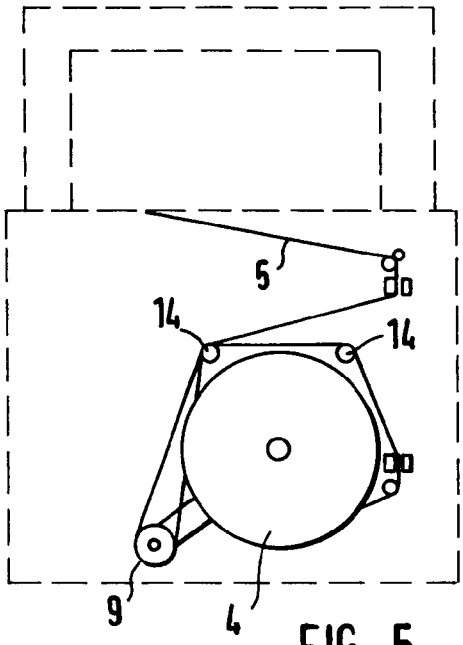
FIG. 5 shows a device of FIG. 3, with a strap carrier guided into the second position.

FIG. 3 shows the situation in which the strapping 5 was taken from the strap-guiding frame 3, as the latter was opening up, and stretched around the packaged material shown in FIG. 3. The re-tensioning takes place owing to the fact that, for example, immediately after sensing technology has detected that the taut strapping 5 has moved linearly between the two clamping means 11 and 12, the clamping means 11, which are close to the roll, are closed and the strapping 5 is arrested there. This means that, in the position shown in FIG. 1, after the injection and capture of the strap and after the linear travel of the strapping has been detected, the clamping means 11 are closed. The strap carrier 6 now moves as shown in FIG. 3 in the direction of arrow B. Since the clamping means 12 are open, the strap carrier 6 pulls the strapping, lying loosely around the packaged material 13, stretches it about the packaged material 13 and, at the same time, passes it into the strap storage system. Depending on the extent, to which the strap carrier 6 is moved here, the tension can be adjusted to a higher or lower value. If an adequate tension is attained, which can also be monitored by a suitable sensor technology, which detects the tension on the strap at a section, downstream from the clamping means 12, the strap is clamped and arrested in the welding device, the details of which are not shown, while, at the same time, the clamping means 12 are also closed. The strap carrier 6 can now remain in this position until, for example, the strapping, which has been stretched around the packaged material, has been welded and cut, in order subsequently to continue the filling of the storage system, for which purpose the clamping means 11 are to be opened. In addition, the possibility also exists, immediately after the clamping means 12 are closed, of opening the clamping means 11 and moving the strap carrier 6 further. Since the strap is to be fixed by means of the clamping means 12, strapping is pulled from the then rotating strap roll 4. The pivoted lever 7 moves into the second position, which is shown in FIG. 5 and which clearly shows that an appropriate length of strap has been pulled off. The pulled-of strapping is passed over appropriate guide rolls 14 and passed into a strap storage system 15, where it is fixed by holding elements, especially in the form of holding brushes, the details of which are not shown. During the injection process, the strapping is pulled out of this strap storage system 15; this will still be dealt with in the following. The exact length of strap, required for the injection and formed from re-tensioned and unwound strap, is then present in the strap storage system 15.

When the second position shown in FIG. 5, is reached, the pivoted lever 7 is passed back into the first position (see FIG. 7) and the strapping, which has been pulled off, remains in the strap storage system 15. For the injection, the clamping means 12 are now opened, so that the strapping 15 can be passed from the storage system through the clamping means 12. The clamping means 11 can be closed during this process, in order to arrest the strapping there. Since the length of strap in the strap storage system 15 corresponds exactly to the length of strap required for the injection, the state, shown in FIG. 1, is reached once again after the injection and the strapping 5 proceeds essentially in a straight line between the clamping means 11 and 12, as can be detected by a sensor or the like. When the sensor gives this signal, the sensing means 11 are closed (if they have not already been closed), after which the re-tensioning process and, later on, the strap pulling-off process for filling the storage system take place once again. Of course, the possibility exists of detecting the length of strap, passed back into the strap storage system 15 during the re-tensioning, by means of suitable sensing technology. Depending on the length determined by these means, the amount of strap, which can still be pulled off from the roll, can then be detected by a suitable control device, so that the storage system is filled with the required length of strap. The length of strap, pulled off, can be detected by a further sensing technology (for example, by determining the actual length of strap or the path of motion of the strap carrier, which is also a measure of the length of strap pulled off) and the motion of the carrier can be controlled depending on what has been determined, until the correct length has been passed into the storage system. This means that the movement of the carrier can be controlled depending on how much strap actually still has to be pulled off. By these means, it is possible to detect and compensate for smaller changes with regard to the length of strap, which has been passed back during the re-tensioning, so that the storage system always contains the required length of strap.

Figure 6:
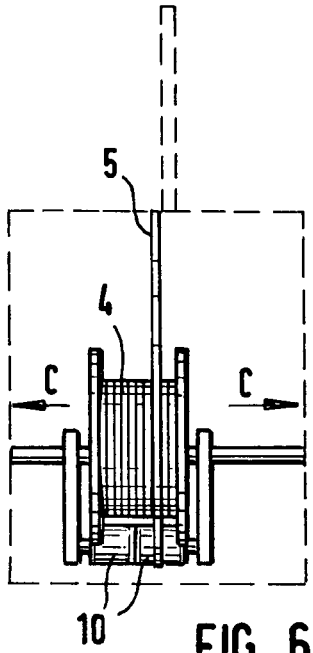
FIG. 6 shows a device of FIG. 5 in a view rotated by 90°.
Figure 7:
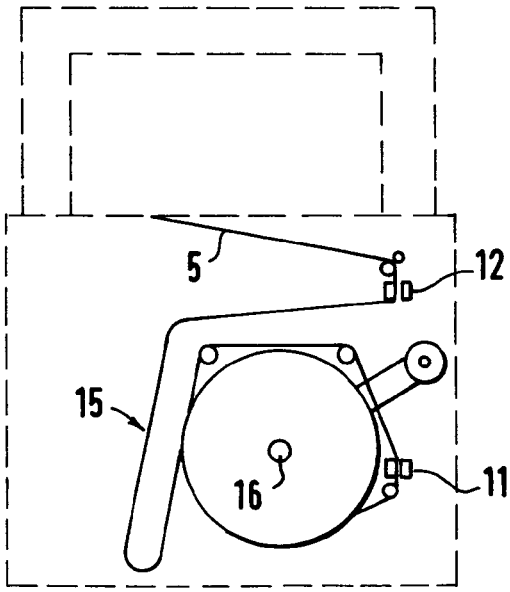
FIG. 7 shows a device of FIG. 5 after the strap carrier has been returned.
Figure 8:
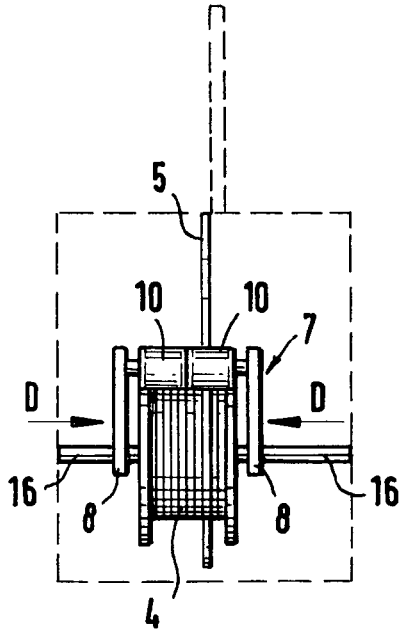
FIG. 8 shows a device of FIG. 7 in a view rotated by 90°.

The course of events, shown in the Figures, reproduces the situation that the pivoted lever 7 can be passed back from the second position (FIG. 5) into the first position (FIG. 7), before the injection process commences and the strapping is pulled out of the strap storage system 15. This is readily possible in the case of slowly clocked devices. However, in the case of devices clocked faster, the injection process can commence already before the pivoted lever 7 once again has reached the first position shown in FIG. 7. In this case, the connecting section 9 would interfere with pulling the strap freely out of the strap storage system 15. This means that strapping, pulled rapidly out of the storage system 15, would bump against the connecting section 9. In order to avoid this, the pivoted lever 7, which is quasi in two parts, can be shifted laterally, as shown in FIG. 6. The two pivoted arms 8 can be shifted laterally along the axle guide 16, as indicated by arrows C, so that the two rolls 10 are no longer in the path of motion of the strapping 15, which is to be pulled off. Since both rollers 10 can be brought out of the path of motion, an unimpeded pulling off of the strap is possible in every case, no matter in which direction the strapping, which is wound on the strapping roll migrating from left to right, runs. When the first position, shown in FIG. 7, is reached, the pivoted arms 8 are pushed back once again, as indicated by the arrows D in FIG. 8, so that the connecting section 9 is closed once again and can engage the strapping for the subsequent pulling-off process.

Instead of the embodiment with a pivoted lever, shown in the Figures, it is also conceivable to use a strap carrier, which can be moved on a straight or bent guide and is quasi guided on a slide rail. By these means also, the strapping can readily be pulled off and introduced into the strap storage system.

The invention claimed is:

1. A device for longitudinally strapping packaged material with strapping, comprising:

a strapping roll from which the strapping is unwound;

a strapping travel path defined between the strapping roll and the packaged material;

a first holding means provided in the strapping travel path that is capable of holding the strapping;

one carrier roll connected to said device by a pivot lever so that the carrier roll pivots between first and second positions along an outer circumferential periphery of the strapping roll;

a strapping storage system disposed between the first and second positions of the carrier roll;

the carrier roll is adapted for engaging the strapping in the strapping travel path between the strapping roll and the first holding means so that:

strapping is not engaged by said carrier roll when said carrier roll is in said first position; and strapping is deposited in the strapping storage system when the carrier roll pivots around the strapping roll from said first position into said second position and said first holding means engages the strapping.

2. The device of claim 1, further comprising:

a second holding means disposed in the strapping travel path between the carrier roll and the strapping roll so that strapping disposed around the package is placed under tension when the second holding means engages the strapping, the first holding means does not engage the strapping and said carrier roll moves from said first position towards said second position.

3. The device of claim 1 wherein the first and/or the second holding means are clamping means.

4. The device of claim 1 wherein the pivot lever comprises two pivot arms that pivot about the pivot axis, and a connecting section comprising the carrier roll is disposed between the two pivot arms; and the pivot arms being capable of simultaneously pivoting about opposing sides of the strapping roll for moving the carrier roll between the first and second positions.

5. The device of claim 1 wherein the pivot lever is capable of being shifted on the pivot axis whereby the carrier roll travels to the first position.

6. The device of claim 4 wherein said connection section comprises two parts, each connected to a respective one of the two pivot arms, and at least one of the pivot arms is capable of translating on the pivot axis of the pivot arms.

7. The device of claim 1 wherein the strapping storage system includes holding elements for holding the strapping deposited in the strapping storage system from the carrier roll.

8. The device of claim 7, wherein the holding elements comprise brushes.

9. The device of claims 1 or 2, wherein the pivotal span of the carrier roll between the first position and the second positions is such that precisely as much strapping is passed into the storage system as is required for a subsequent strapping process.

10. The device of claims 1 or 2 wherein the pivotal span of the carrier roll is capable of being adjusted or varied.

11. The device of claims 1 or 2, wherein the pivot lever is capable of being pivoted about the axis of rotation of the strapping roll.

12. The device of claim 6, wherein the carrier roll comprises two rolls.

13. A device for longitudinally strapping packaged material with strapping, comprising:

a strap roll from which the strapping is pulled with formation of a strap storage system for a subsequent strapping process, the scrap roll rotating on an axis of rotation;

a movable strap carrier is provided for pulling off the strapping, the movable strap carrier being movable from a first position into a second position and the movable strap carrier carries the strapping when moving from the first position to the second position and then returns to the first position;

holding means for arresting the strapping are provided downstream from the strap carrier; and the strap carrier being capable of shifting on and parallel to the axis of rotation of the strap roll for carrying out the return movement into the first position.

14. A device for longitudinally strapping packaged material with strapping, comprising:

a scrap roll from which the strapping is pulled with formation of a strap storage system for a subsequent strapping process;

a movable strap carrier is provided for pulling off the strapping, the movable strap carrier being movable from a first position into a second position and the movable strap carrier carries the strapping when moving from the first position to the second position;

holding means for arresting the strapping are provided downstream from the strap carrier;

the strap carrier comprises a pivot lever which comprises two pivot arms pivoting about a pivot axis, the pivot arms being movable at a side of the strap roll and being connected over a connecting section engaging the strapping; and the connecting section comprising two parts where at least one of the pivot arms is capable of being shifted on and parallel to said pivot axis of the pivot arms.

* * * * *